US006982677B2

(12) United States Patent
Kennedy et al.

(10) Patent No.: US 6,982,677 B2
(45) Date of Patent: Jan. 3, 2006

(54) SLOT ANTENNA

(76) Inventors: Colm C Kennedy, 17177 San Jose St., Granada Hills, CA (US) 91344; Duane K Mc Nutt, 5004 Alvarado Rd., Carpinteria, CA (US) 93013

( * ) Notice: Subject to any disclaimer, the term of this patent is extended or adjusted under 35 U.S.C. 154(b) by 84 days.

(21) Appl. No.: 10/689,115

(22) Filed: Oct. 18, 2003

(65) Prior Publication Data

US 2005/0083238 A1 Apr. 21, 2005

(51) Int. Cl.
*H01Q 13/10* (2006.01)

(52) U.S. Cl. ..... 343/767

(58) Field of Classification Search ..... 343/767, 343/770, 771, 768, 700 MS, 782, 705, 708
See application file for complete search history.

(56) References Cited

U.S. PATENT DOCUMENTS

| | | | | |
|---|---|---|---|---|
| 3,623,162 A | * | 11/1971 | Whitty | 343/767 |
| 4,129,866 A | | 12/1978 | Turco | 342/158 |
| 4,197,547 A | | 4/1980 | Czerwinski | 343/708 |
| 4,348,680 A | * | 9/1982 | Collier | 343/778 |
| 5,825,332 A | | 10/1998 | Camacho | 343/708 |
| 5,990,844 A | * | 11/1999 | Dumont et al. | 343/770 |
| 6,094,171 A | * | 7/2000 | Riddle et al. | 343/708 |
| 6,097,343 A | | 8/2000 | Goetz et al. | 343/708 |

* cited by examiner

*Primary Examiner*—Don Wong
*Assistant Examiner*—Huedung X. Cao
(74) *Attorney, Agent, or Firm*—IPLA P.A.; James E. Barne

(57) ABSTRACT

The slot antenna is mountable on the Hercules aircraft dorsal fin. The slot antenna includes a lower plate that forms a false spar, an upper plate adjacent to the lower plate, an antenna element, and a tuner operatively connected to the antenna element. The antenna element is integrated within the upper plate. The slot antenna includes a Radio Frequency feed line that operatively connects the tuners to the antenna element.

18 Claims, 5 Drawing Sheets

SLOT ANTENNA

BACKGROUND

The field of design is antennae for aircraft. In particular the field of design is shunt antennae. Shunt antennae have been used many places over the years. Basically the term refers to antennae, which are grounded at one end and fed low voltage and high amperage radio frequencies to cause radio frequency (RF) propagation.

Slot antennae fall into this category and they have been used on aircraft vertical and horizontal tail surfaces for many years. Their use on tail surfaces causes the whole tail to become a radiator and results in an almost equal 360-degree propagation of the RF signal. The entire tail surface becomes a radiator of the RF signals from the antenna, which increases the surface area of the antenna and increases the propagation of the RF signal in all directions.

Prior to the advent of slot antennae, commercial jet transport aircraft were equipped with "long wire" antennae whose high-speed drag was unacceptable, though used, on the early jets. These antennae were required to communicate on high frequency ("HF"), a band of frequencies in the range of 2 mhz–20 mhz, designated by international treaty and used for contacts over 200 miles. 2182 kilohertz is the international distress signal. Other types of aircraft currently use the long wire antenna to attain this lower range.

A vertical stabilizer HF slot antenna, which covered most of the band, was developed by Eastern Air Lines (EAL) for the B727. The design was apparently never patented and is a version that is found on every Boeing today. Its failure to cover the lower frequencies is due to its shorter length, which is limited by stabilizer space considerations. To feed it efficiently its tuners are mounted in the vertical stabilizer, which is a very harsh environment of temperature and pressure extremes.

Most jets now flying internationally use tail mounted HF slot antennae, some with more success than others. No one had produced an HF slot antenna mounted anywhere other than the tail and it was believed by the airplane industry that any antenna placed elsewhere would be ineffective. Industry wisdom has for years held that for slot antenna to be effective they had to be part of the empennage to get it to properly radiate the signal. The empennage is the tail fin area with the vertical stabilizer and the horizontal stabilizer.

The Lockheed Hercules C-130 models A thru H and its civilian version L-382 were all produced with two antenna masts and two long wire antennae terminating high on the vertical stabilizer. On the later version, Lockheed Hercules C-130 "J" model, Lockheed incurred significant development costs to modify the empennage structure at the base of the vertical stabilizer to make room (physically and electronically) for a "notch"(shunt) antenna because it was believed there was nowhere else for the antenna to go. Due to the particular constraints of the existing Hercules stabilizer anti-icing system it was believed by the industry that the base of the vertical stabilizer was the only location for a notch antenna. All models of the Hercules have this stabilizer anti-icing system, therefore it is a constraint to the location of mounting an antenna that must be considered on all models. This notch antenna installation is available from Lockheed on older "A"–"H" models for retrofit at a price of approximately $250,000 with a long down time. The latest model Hercules C-130"J" are manufactured with this style notch antenna at a price buried in the purchase price.

Avionics equipment on aircraft is mounted so that it is constantly surrounded by conditioned air in its ideal environment. Tuners placed high in the tail are operating under difficult conditions, which occurs with the previous design for the Hercules C-130"J". Significant efficiency benefits result from the closeness of the tuners to the antenna element. Shunt antennas work at a very low voltage of approximately 1.5 Volts and a high amperage of 75 Amps plus. This makes long feed lines from tuner to antenna counterproductive due to voltage drop and the consequent power loss. Vertical stabilizer mounted shunt antennae mandated mounting the tuners high in the stabilizer in non-pressurized, unheated, and inaccessible areas. It would be advantageous to mount the tuner units where they should be, inside and very close to the feed end of the antenna.

Therefore there is a need for a slot antenna that can be mounted away from the empennage area. Furthermore, the tuners should be mounted in an interior environment with a short feed line from the tuners to the antenna element.

SUMMARY

An objective of the slot antenna is providing an antenna that can be retrofitted to existing Hercules aircraft in a location other than the empennage tail section of the aircraft.

Another objective is creating a better environment for the mounting of the tuners, which are often subjected to the extreme conditions of high altitude environments. This provides improved reliability and durability of the tuner components. Another objective is mounting the tuners in an easily accessible area. Installation costs, maintenance costs, maintenance equipment requirements and time are all significantly reduced by the improved accessibility.

Another objective of the slot antenna is creating an antenna structure that can be fed RF signals from the end remote from the empennage. The benefit of such a design is that it is much easier to mount the tuners in the improved environment of the cargo cabin roof area. An additional benefit is that the RF feed line can be significantly reduced in length, which minimizes interferences and improves reception.

Another objective of the slot antenna is integrating the antenna into the existing dorsal fin of the aircraft, such that, the structural integrity of the fuselage is maintained. Due to the particular constraints of the existing Hercules stabilizer anti-icing system it was believed by the industry that a slot antenna could not be located within the dorsal fin. The industry believed that the base of the vertical stabilizer was the only location for a slot antenna.

Another objective is producing an economically viable alternative to the traditional long wire antenna. The benefit is significant reduction in air drag and the associated fuel costs that occur with the long wire antenna. 2182 kilohertz is the international distress signal. Other types of aircraft must use a long wire antenna to attain this lower range. The new design would be advantageous here for providing this capability on the "A–H" model Hercules, without the need for a long wire antenna.

Another objective of the slot antenna is a design that can be installed without additional down time during a routine A-1 or B aircraft maintenance check. This significantly reduces the loss of revenue that occurs with grounded airplane.

The slot antenna is mountable on the Hercules aircraft dorsal fin. The slot antenna includes a lower plate that forms a false spar, an upper plate adjacent to the lower plate, an antenna element, and a tuner operatively connected to the antenna element. The antenna element is integrated within the upper plate. The slot antenna includes a Radio Frequency feed line that operatively connects the tuners to the antenna element.

The tuner transmits radio frequency (RF) signals to the antenna element. The antenna element and the lower plate become charged by the RF signals. The antenna element and the lower plate are substantially separate by air, thus the charged upper plate and lower plate separated by the air insulator produce a capacitor effect.

The antenna element has a front-end that is facing towards the nose of the aircraft and a back-end that is closer to the tail of the aircraft. The tail of the aircraft forms the empennage. The antenna element forms three prongs; a center prong, a first lower prong and a second lower prong. The three prongs are connected at the back-end of the antenna element. The three prongs are substantially separated by a fiberglass plate throughout most of the length of the antenna element and at the front-end.

The center prong has a width dimension 'W1', which normally is between about 10 inches and about 6 inches. The first lower prong and the second lower prong have a width dimension 'W2', which is typically between about 4 inches and about 2 inches. In a preferred embodiment the first lower prong and the second lower prong are the same in width and are the same in length. The center prong has a length dimension 'L1' that is typically between about 120 inches and about 110 inches. The first lower prong and the second lower prong have a length dimension 'L2'. The lower plate has a length 'L3'.

The center prong has an apex. The apex and the lower plate are separated by a distance 'D1'. There is a relationship between the dimensions 'W1', 'W2', 'L1', 'L2', 'L3' and 'D1' that effects the coordinating of the upper plate and lower plate to function appropriately with the characteristics of the tuner. In one version that provides an RF signal that will radiate long distances, 'W1' is about 8.0 inches, 'W2' is about 3.0 inches, 'L1' is about 116.5 inches, 'L2' and 'L3' are about 134.5 inches, and 'D1' is about 7.5 inches.

There are one or more tuners mounted within the interior of the aircraft fuselage. The tuners are mounted on a tandem rack, which is a front and back arrangement of the tuners. Prior art designs used a side-by-side mounting of the tuners. The space restraints of the interior of the Hercules aircraft required the innovation of a new design for the tuner mounting rack.

The new design slot antenna when mounted in place of the crown skin on the dorsal fin of the Lockheed Hercules (after structural beef up of the fin) and when fed from the end most remote from the empennage, by tuners mounted in the cargo cabin, produces a level of all around HF propagation never before experienced in an "A"–"H" model Hercules and does so over the entire 2 mhz–20 mhz of the HF band. It was necessary to provide structural strengthening of the dorsal fin, to compensate for the structural components that were modified or removed to provide sufficient space for the antenna parts. The shape and dimensions of various structural components within the dorsal fin were modified and became a part of the antenna.

The design of the antenna had to be tailored to fit the dorsal fin and (a) be responsive to the frequency band, (b) have inductive and capacitive properties compatible with the envelopes of the commercially available automatic tuners which have limited capabilities to tune in three functions (series and shunt capacitive tuning and series reactive tuning) and (c) be structurally acceptable as replacement equipment. To accommodate the capacitive requirements it was found necessary to install a false spar located above the structural replacement units.

The new design antenna can be provided and installed for less than ⅓ the price of the prior Lockheed retrofit design. The fuel savings resulting from the antenna drag reduction is calculated to pay for it and its installation in two years of commercial cargo flying. The fuel saving is based on comparison to the frictional drag of the Hercules existing long wire antenna. The slot antenna will support the digital automatic position reporting system now going into operation worldwide, which could not be done with the old long-wire system. The international accepted protocol for automatic reporting makes technical demands on the system not supportable by the long wire antenna tuning time capabilities. The antenna and it's supporting system is so designed it can be installed without added down time during a routine A-1 or B aircraft maintenance check (5–7 days).

A tandem mounted rack was designed to accommodate feeding the antenna from the end remote from the empennage. Prior designs were the traditional side-by-side double mounted rack. The repositioning of the antenna tuners within the interior of the fuselage keeps them in a much better environment. Reliability of the equipment is improved when mounted in the pressurized cabin with conditioned air temperatures versus outside ambient temperatures that range from +130° F. to −40° F. The outside air pressure varies significantly over the range of sea level to 30,000' that are normal flying conditions. The interior location allows service or exchange from inside the fuselage with no more required than mounting a stepladder inside in lieu of a tall cherry picker outside.

The design of the tandem mount rack for the tuners allows them to be mounted in the optimum electrical location without interference from control cables and load drop system components in the upper cabin area while allowing the critical RF feed line to be very short at about 5.5" versus 30" on previous designs. With good HF propagation conditions, worldwide communications can be anticipated from cruising altitudes.

The placement of slot antenna within the dorsal fin required the removal of existing support structure and the installation of a false spar that serves as the lower plate of the antenna, which balances the antenna electronically. The replacement of rib structural mounts to create a bottom cavity is necessary. Removal of the rib structure was necessary because its effect as a capacitive ground would be too much, due its proximity to the antenna element. Modified supports items are installation for structural reasons and installation of the cover pieces brought the value of the capacitive component of the antenna assembly up to where the tuners could handle it. The antenna is tweaked by dimensional adjustments to conform to the preset envelope of characteristics required by the standard tuner. The overall design allowed for feeding the antenna from the end remote from the empennage, which was previously believed by the industry to be unattainable. Positioning the antenna tuners in the cargo cabin roof area created a better environment and higher electronic efficiency.

The interior mounting provides ease of maintenance service. Units can be changed without special hi-lift equipment, which is normally only available in an aircraft maintenance hangar. The initial retrofitting of the slot antenna into the aircraft is performed in shorter time period due to the tuners being mounted on the interior versus high in the tail. Structural modifications and attachment methods to the interior of an aircraft are not as critical as modifications affecting the exterior surface. Smooth exterior surfaces must be carefully maintained to minimize the air drag and separation of exterior panels at high speeds.

The length of the antenna element makes the antenna 30 percent longer than the traditional Boeing antenna. The longer antenna length allows going to the bottom of the transmission frequency band, which is important for military applications. The bottom of the frequency band is particularly required for Navy and Coast Guard usage. 2182 khz is the international marine HF emergency frequency and many close frequencies are used in ship-to-ship and ship-to-shore traffic control.

Although the present invention is briefly summarized, a fuller understanding of the invention can be obtained from the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1A:
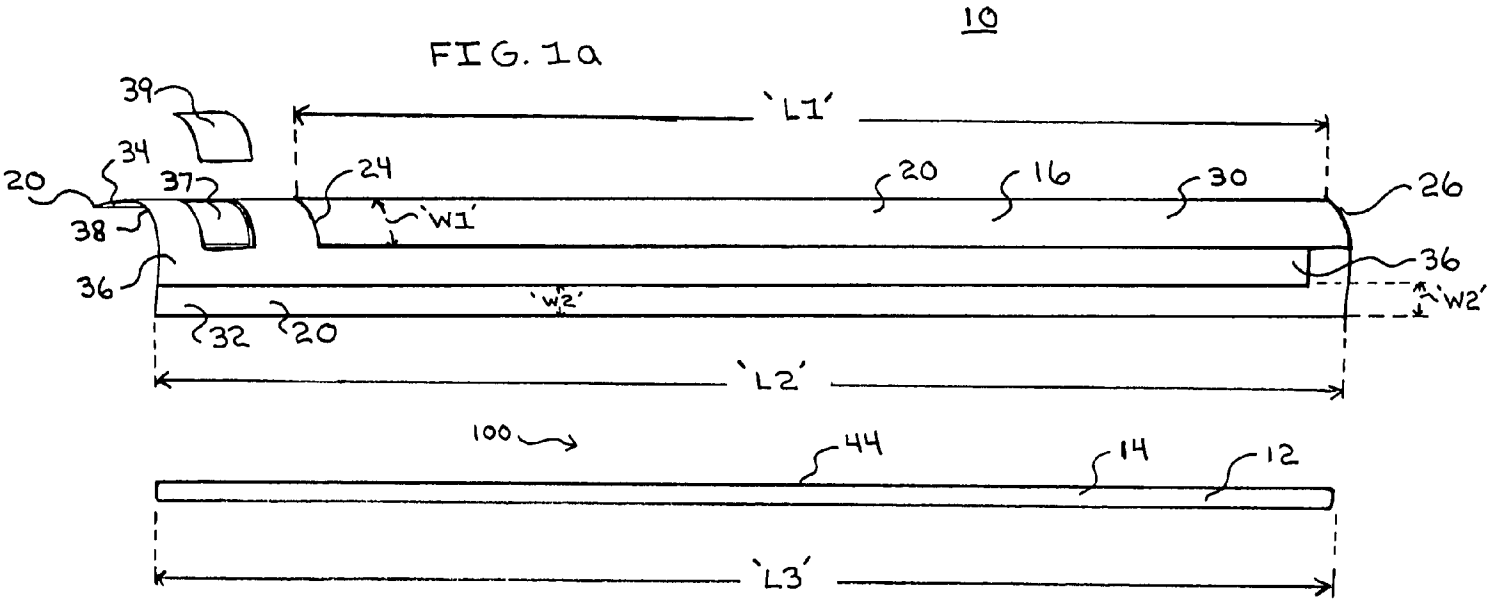
FIG. 1*a* is a top/side perspective view.
Figure 1B:
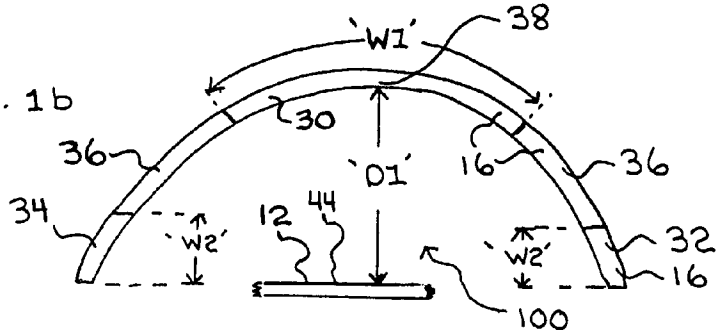
FIG. 1*b* is a cutaway view along the center of the antenna element.

Referring to FIGS. 1*a* and 1*b*, which illustrate a slot antenna 10 mountable on the Hercules aircraft 102 dorsal fin. The slot antenna 10 includes a lower plate 12 that forms a false spar 14, an upper plate 16 adjacent to the lower plate 12, an antenna element 20, and a tuner 22 operatively connected to the antenna element 20. The antenna element 20 is integrated within the upper plate 16. The upper plate 16 that contains the antenna element 20 replaces a portion of the crown skin of the fuselage. The upper plate 16 forms the shape of the existing crown skin, which it replaces. The tuner 22 transmits radio frequency (RF) signals to the antenna element 20. The antenna element 20 and the lower plate 12 become charged by the RF signals. The antenna element 20 and the lower plate 12 are substantially separate by air 100, thus the charged upper plate 16 and lower plate 12 separated by the air insulator produce a capacitor effect.

The antenna element 20 has a front-end 24 that is facing towards the nose of the aircraft 102 and a back-end 26 that is closer to the tail 104 of the aircraft 102. The tail 104 of the aircraft 102 forms the empennage 108, which includes the vertical stabilizer 110 and the horizontal stabilizer 112. The antenna element 20 forms three prongs; a center prong 30, a first lower prong 32 and a second lower prong 34. The three prongs are connected at the back-end 26 of the antenna element 20. The three prongs are substantially separated by a fiberglass plate 36 throughout most of the length of the antenna element 20 and at the front-end 24. The first lower prong 32 and the second lower prong 34 are in grounded contact with the lower plate 12 and the sides of the fuselage of the airplane. Large bolts and other metallic structural components provide grounding contact between the antenna and the empennage 108 area, which provides a path for the RF signals to travel.

The antenna element 20 is grounded at its back-end 26 near the empennage 108. The tuner 22 feeds energy into the front-end 24 of the antenna element 20. The RF signal energy radiates through the antenna element 20 towards the grounded end of the antenna element 20 and into the empennage 108 at the tail 104 of the airplane. The vertical stabilizer 110 and the horizontal stabilizer 112 are at right angles to each other, thus they provide excellent radiation of the RF signal in multiple directions.

The center prong 30 has a width dimension 'W1', which normally is between about 10.0 inches and about 6.0 inches. In a preferred embodiment the width dimension 'W1' of the center prong 30 is about 8.0 inches. The first lower prong 32 and the second lower prong 34 have a width dimension 'W2', which is typically between about 4 inches and about 2 inches. The width 'W1' is measured as a circumference. In a preferred embodiment the first lower prong 32 and the second lower prong 34 are the same in width and are the same in length. The width dimension 'W2' of the first lower prong 32 and the second lower prong 34 is about 3.0 inches.

The center prong 30 has a length dimension 'L1' that is typically between about 120 inches and about 110 inches. About 116.5 inches is a preferred length for dimension 'L1'. The first lower prong 32 and the second lower prong 34 have a length dimension 'L2', which is about 134.5 inches. The lower plate 12 has a length 'L3' that is also about 134.5 inches. The length of the antenna element 20 determines the frequency you can achieve. The longer the length the lower the attainable frequency, which provides a significant advantage for the present design.

The center prong 30 has an apex 38. The apex and the lower plate 12 are separated by a distance 'D1'. There is a relationship between the dimensions 'W1', 'W2', 'L1', 'L2', 'L3'and 'D1' that effects the coordinating of the upper plate 16 and lower plate 12 to function appropriately with the characteristics of the tuner 22. In one version that provides an RF signal that will radiate long distances, 'W1' is about 8.0 inches, 'W2' is about 3.0 inches, 'L1' is about 116.5 inches, 'L2' and 'L3' are about 134.5 inches, and 'D1' is about 7.5 inches.

Figure 2A:
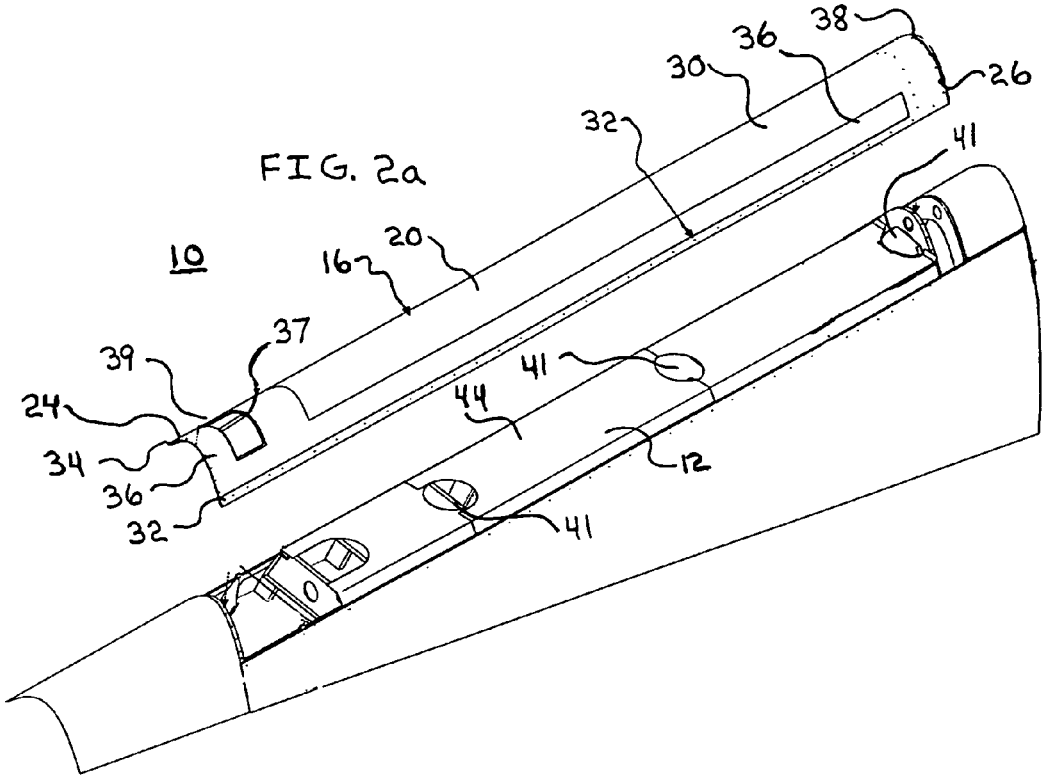
FIG. 2*a* is an exploded top/side perspective view.
Figure 2B:
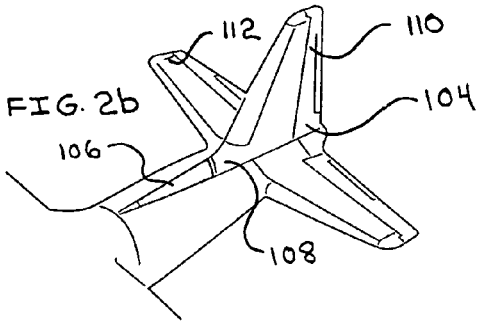
FIG. 2*b* is a top/side perspective view.
Figure 2C:
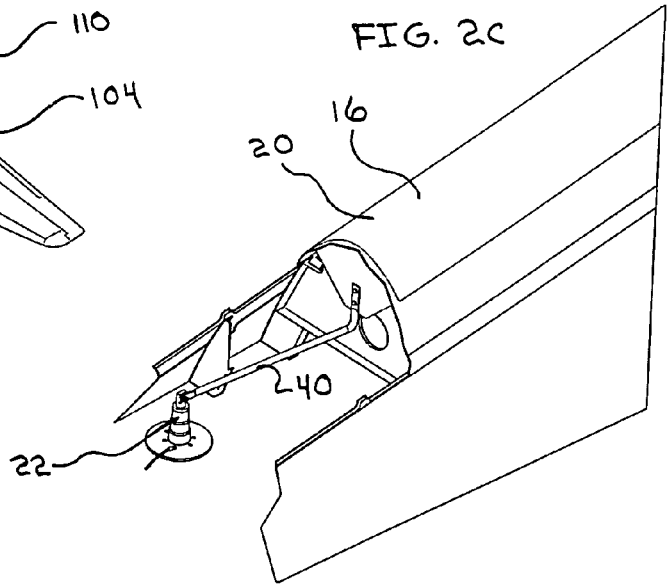
FIG. 2*c* is a top/side perspective view.

Referring to FIGS. 2*a*, 2*b*, and 2*c*, the upper plate 16 with the antenna element 20 replaces the crown skin along a portion of the dorsal fin. Previous designs had the antenna located within the empennage 108 area and it was believed by the industry that an antenna mounted in the dorsal fin area would not be operative.

FIG. 2*a* shows an exploded view with the upper plate 16 removed from the dorsal fin area. The lower plate 12 is separated into three pieces. The lower plate 12 forms apertures 41 that provide for ease of access for installation and removal of the lower plate 12. The apertures 41 also provide ventilation and access for inspection of the underlying components. FIG. 2*b* shows the tail 104 fin area of the aircraft 102 with the dorsal fin 106 area adjacent and in front of the tail 104 fin.

FIG. 2*c* has the radio frequency feed line 40 connected between the tuners 22 and the antenna element 20. The tuners 22 are mounted near the antenna element 20, thus power losses are minimized. The interior of an aircraft 102 is subjected to significant electromagnetic fields that tend to interfere with the RF transmissions. Locating the tuners 22 close to the antenna element 20 is an advantage and contributes to increased transmission distances. RF transmissions over significant distances have been achieved with this slot antenna 10 innovation. The fiberglass plate 36 forms an access cutout 37 for access to the feed line 40. An access cover 39 provides a tight seal over the access cutout 37.

Figure 3A:
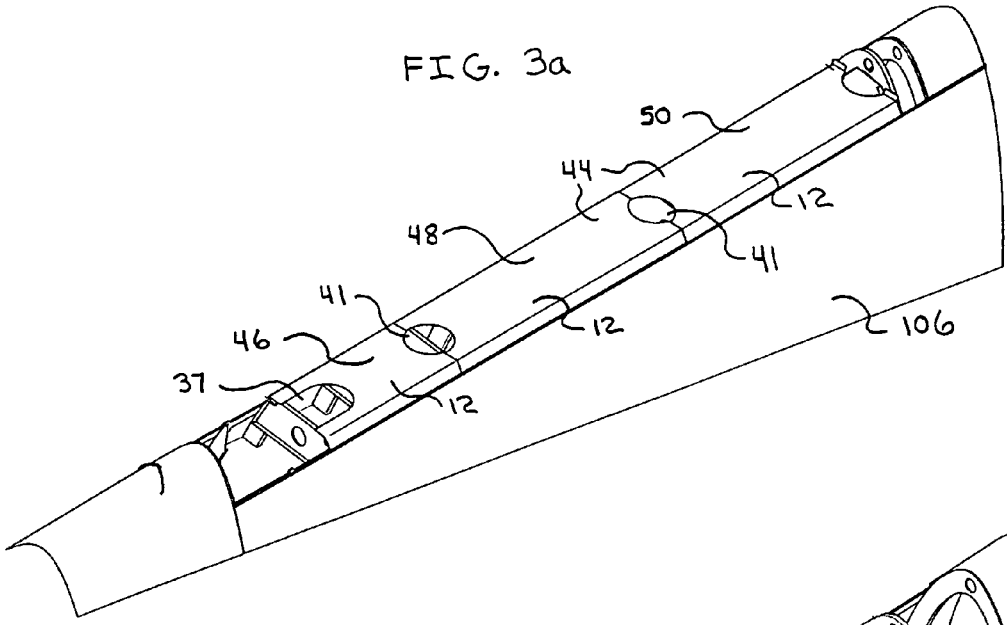
FIG. 3*a* is a top/side perspective view of the lower plate.
Figure 3B:
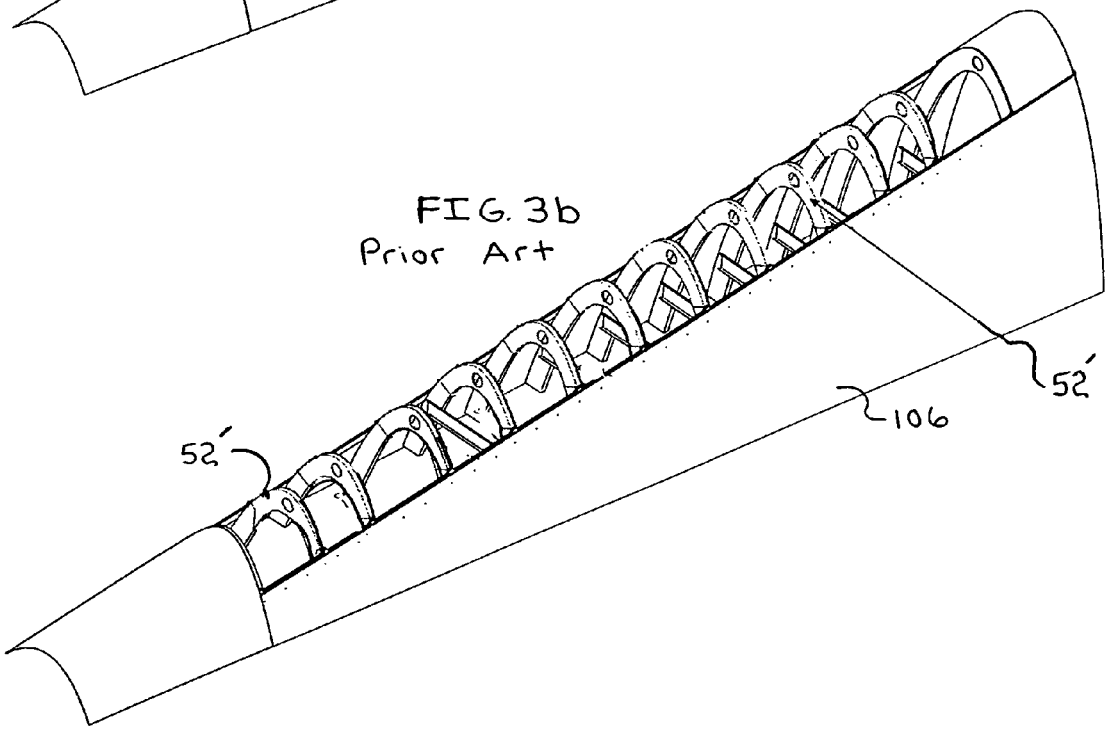
FIG. 3b Prior Art
FIG. 3*b* is a Prior Art top perspective view of the structural ribs.
Figure 3C:
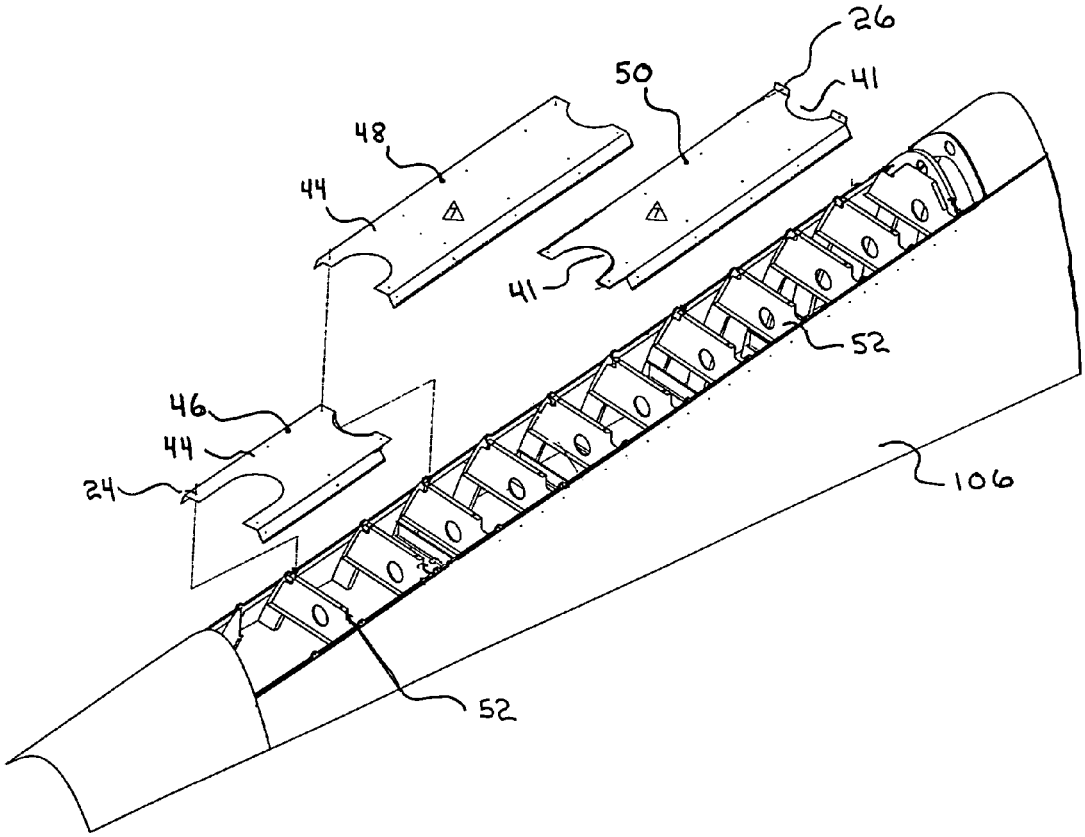
FIG. 3*c* is a top/side perspective view.

Referring to FIGS. 3*a*, 3*b*, and 3*c* that illustrate the modifications made to the aircraft 102 structure to accommodate the slot antenna 10. FIG. 3*b* shows the existing dorsal fin support structure prior to the modifications. The numerous support ribs 52' are rounded or elliptical in shape. FIG. 3*c* illustrates the dorsal fin structure after the support ribs 52 modifications. The new ribs 52 are reduced in height and flat along their upper edge. A false spar 14 is created when the lower plate 12 is mounted on top of the ribs 52. The reduction in rib height is needed to create a separation distance between the lower plate 12 and the upper plate 16 for the proper functioning of the antenna. The lower plate 12 is divided into three sections.

Referring particularly to FIG. 3*c*, the lower plate 12 has a top surface 44 that is substantially flat. The lower plate 12 comprises three separate sections that are a first section 46, second section 48 and third section 50. The three section 46, 48, 50 are easily removed and reattached during maintenance routines. The tuner 22 transmits radio frequency signals to the antenna element 20, which radiate towards the grounded back-end 26 of the antenna element 20. The back-end 26 is grounded near the empennage 108 and the RF signals will tend to radiate into the empennage 108 area. The antenna element 20 and the lower plate 12 produce a capacitor effect.

Figure 4A:
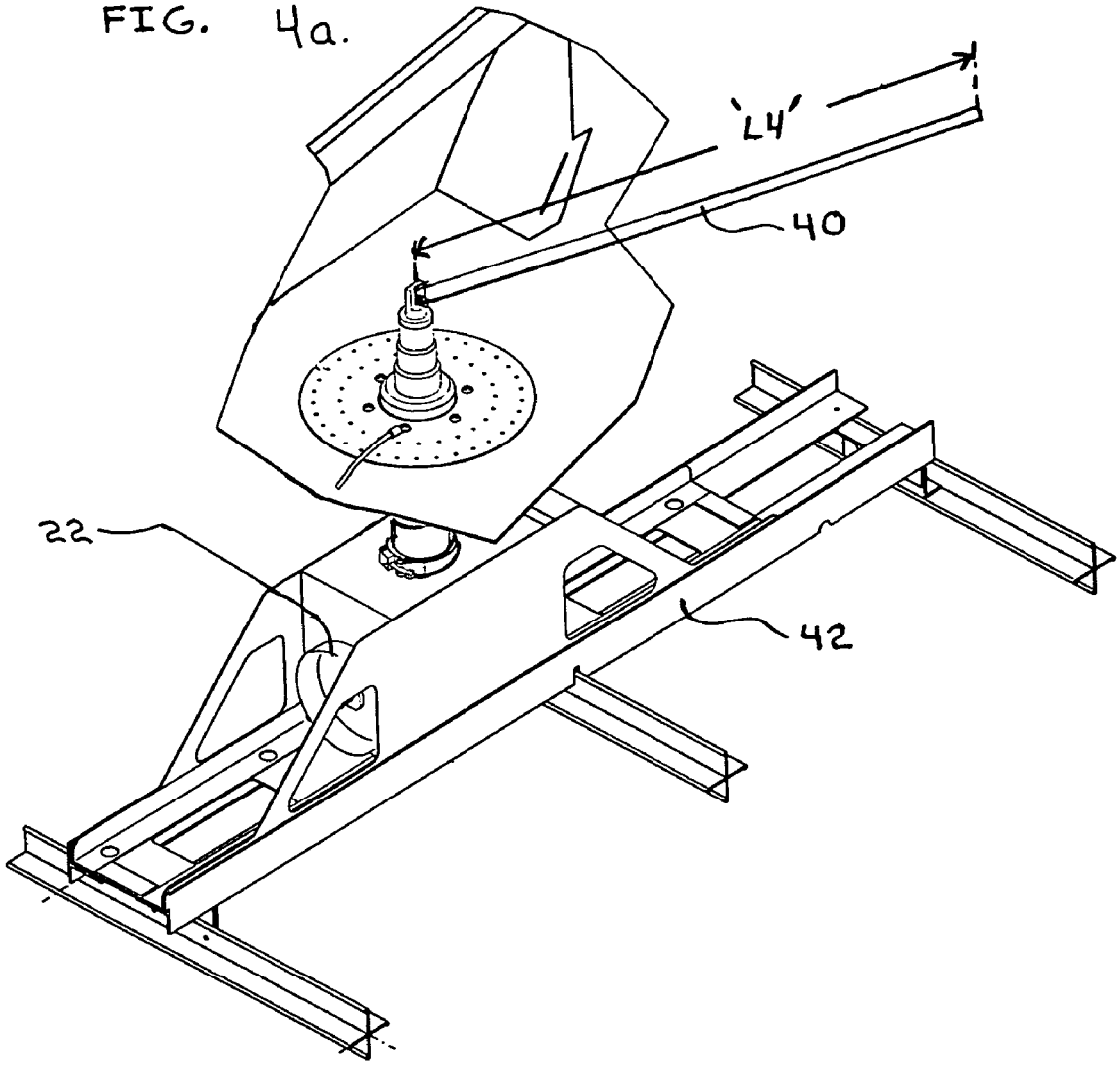
FIG. 4*a* is a top/side perspective view of the tuner.
Figure 4B:
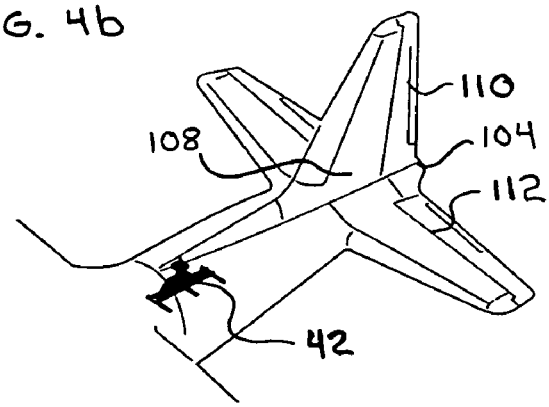
FIG. 4*b* is a top/side perspective view of tuner the location.

Referring to FIGS. 4*a* and 4*b*, the slot antenna 10 includes a Radio Frequency feed line 40 that operatively connects the tuner 22 to the antenna element 20. The feed line 40 has a length "L4", which is about 5.5 inches. The tuner 22 is connected to the front-end 24 of the antenna element 20. There are one or more tuners 22 mounted within the interior of the aircraft 102 fuselage. The tuners 22 are mounted on a tandem rack 42.

Prior art designs (not shown) used two side by side mounting racks for the tuners 22. The space restraints of the interior of the Hercules aircraft 102 required the innovation of a new design for the tuner 22 mounting rack. The tandem rack 42 places the tuners 22 front to back of each other. This arrangement allows for two tuners 22 to both be fed directly into the same feed line 40. The interior mounting allows easy access for maintenance and replacement of the tuners 22. The tandem rack 42 fits into a much tighter space than prior mounting rack designs.

The entire design of the slot antenna 10 is uniquely suited for retrofitting on the dorsal fin 106 of the Lockheed aircraft 102 Hercules Models 'A–H'. The slot antenna 10 has many advantages including: an improved inside environment for the tuners; a shorter RF feed line connected to the end remote from the empennage, which improves efficiency; reduced air drag; economically viable installation, reduced maintenance time and reduced maintenance costs.

Although the present invention has been described in considerable detail with regard to the preferred versions thereof, other versions are possible. Therefore, the appended claims should not be limited to the descriptions of the preferred versions contained herein.

What is claimed is:

1. A slot antenna mountable on the Hercules aircraft dorsal fin comprising:

a) a lower plate;

b) an upper plate adjacent to the lower plate;

c) an antenna element; and d) a tuner operatively connected to the antenna element;

wherein, the tuner transmits radio frequency signals to the antenna element, wherein the antenna element and the lower plate produce a capacitor effect, wherein the antenna element is integrated within the upper plate, and, wherein the antenna element having a center prong, a first lower prong and a second lower prong, wherein the three prongs are substantially separated by a fiberglass plate.

2. The slot antenna of claim 1, wherein the center prong having a width dimension 'W1', wherein the width dimension 'W1' is between about 10 inches and about 6 inches.

3. The slot antenna of claim 2, wherein the width dimension 'W1' of the center prong is about 8.0 inches.

4. The slot antenna of claim 3, wherein first lower prong and the second lower prong having a width dimension 'W2', wherein the width dimension 'W2' is between about 4 inches and about 2 inches.

5. The slot antenna of claim 4, wherein the width dimension 'W2' of the first lower prong and the second lower prong is about 3.0 inches.

6. The slot antenna of claim 5, wherein the center prong having a length dimension 'L1', wherein the length dimension 'L1' as between about 120 inches and about 110 inches.

7. The slot antenna of claim 6, wherein the length dimension 'L1' of the center prong is about 116.5 inches.

8. The slot antenna of claim 7, wherein the center prong having an apex, wherein the apex and the lower plate are separated by a distance 'D1', wherein 'D1' is about 7.5 inches.

9. The slot antenna of claim 8, wherein the first lower prong and the second lower prong having a length dimension 'L2', wherein the length dimension 'L2' is about 134.5 inches.

10. The slot antenna of claim 9, wherein the lower plate having a length 'L3', wherein the length 'L3' is about 134.5 inches.

11. The slot antenna of claim 10, further having a Radio Frequency feed line with a length "L4", wherein the feed line operatively connects the tuners to the antenna element, wherein the length "L4" is about 5.5 inches.

12. The slot antenna of claim 11, wherein the aircraft is one of the Lockheed Hercules Models 'A–H'.

13. The slot antenna of claim 12, wherein the tuners are mounted within the interior of the aircraft fuselage.

14. The slot antenna of claim 13, further comprising a tandem rack, wherein there are a plurality of tuners, wherein the plurality of tuners are mounted in the tandem rack, wherein the plurality of tuners are mounted front to back of each other, and wherein the tuners are both connected to the same feed line.

15. A slot antenna mountable on the Hercules aircraft dorsal fin and adjacent to the aircraft empennage comprising:

a) a lower plate;

b) an antenna element having a frontend and a back-end; and c) a tuner operatively connected to the front-end of the antenna element;

wherein the tuner transmits radio frequency signals to the antenna element, wherein the aircraft having an empennage, wherein the back-end being adjacent to and connectedly grounded to the empennage, wherein the antenna element and the lower plate are separated by air, thereby producing a capacitor effect, and whereby the radio frequency signals will tend to radiate towards the grounded back-end of the antenna element and into the empennage area.

16. The slot antenna of claim 15, further having a Radio Frequency feed line with a length "L4", wherein the feed line operatively connects the tuners to the antenna element, wherein the length "L4" is about 5.5 inches.

17. The slot antenna of claim 16, further comprising a tandem rack, wherein there are a plurality of tuners, wherein the plurality of tuners are mounted in the tandem rack, wherein the plurality of tuners are mounted front to back of each other, and wherein the tuners are both connected to the same feed line.

18. The slot antenna of claim 17, wherein the lower plate having a length 'L3', wherein the length 'L3' is about 134.5 inches, thereby increasing the propagation distance of the radio frequency signal.

* * * * *